US010661334B2

(12) United States Patent
Shibasaki et al.

(10) Patent No.: US 10,661,334 B2
(45) Date of Patent: May 26, 2020

(54) AMORPHOUS ALLOY RIBBON AND METHOD OF PRODUCING THE SAME

(71) Applicant: HITACHI METALS, LTD., Tokyo (JP)

(72) Inventors: Hiroshi Shibasaki, Yasugi (JP); Takayuki Motegi, Yasugi (JP); Hajime Itagaki, Yasugi (JP); Jun Sunakawa, Yasugi (JP); Yoshio Bizen, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 50 days.

(21) Appl. No.: 15/334,803

(22) Filed: Oct. 26, 2016

(65) Prior Publication Data

US 2017/0044648 A1 Feb. 16, 2017

Related U.S. Application Data

(62) Division of application No. 14/384,537, filed as application No. PCT/JP2013/056354 on Mar. 7, 2013, now Pat. No. 9,604,278.

(30) Foreign Application Priority Data

Mar. 15, 2012 (JP) ..... 2012-058715

(51) Int. Cl.
*C22C 45/02* (2006.01)
*B22D 11/00* (2006.01)
(Continued)

(52) U.S. Cl.
CPC ..... *B22D 11/001* (2013.01); *B22D 11/0611* (2013.01); *B22D 11/0682* (2013.01);
(Continued)

(58) Field of Classification Search
None
See application file for complete search history.

(56) References Cited

U.S. PATENT DOCUMENTS 4,783,983 A 11/1988 Narasimhan
5,334,262 A 8/1994 Sawa
(Continued)

FOREIGN PATENT DOCUMENTS

JP 57116356 U 7/1982
JP 58176061 A 10/1983
(Continued)

OTHER PUBLICATIONS

Communication dated Aug. 8, 2017, from the Japanese Patent Office in counterpart application No. 2016-191564.
(Continued)

*Primary Examiner* — George Wyszomierski
(74) *Attorney, Agent, or Firm* — Sughrue Mion, PLLC

(57) ABSTRACT

The invention provides a method of producing an amorphous alloy ribbon, the method including a step of producing an amorphous alloy ribbon by discharging a molten alloy through a rectangular opening of a molten metal nozzle having a molten metal flow channel along which the molten alloy flows, the opening being an end of the molten metal flow channel, onto a surface of a rotating chill roll, in which, among wall surfaces of the molten metal flow channel, a maximum height Rz(t) of a surface t, which is a wall surface parallel to a flow direction of the molten alloy and to a short side direction of the opening, is 10.5 μm or less.

2 Claims, 4 Drawing Sheets

(51) Int. Cl.

| | |
|---|---|
| ***B22D 11/06*** | (2006.01) |
| ***B22D 11/10*** | (2006.01) |
| ***C22C 45/04*** | (2006.01) |
| ***C22C 1/00*** | (2006.01) |
| ***C22C 33/00*** | (2006.01) |
| ***C22C 45/00*** | (2006.01) |
| ***B22D 11/103*** | (2006.01) |
| ***B22D 11/124*** | (2006.01) |
| ***C21D 9/52*** | (2006.01) |
| ***C22F 1/00*** | (2006.01) |

(52) U.S. Cl.

CPC ..... *B22D 11/10* (2013.01); *B22D 11/103* (2013.01); *B22D 11/124* (2013.01); *C21D 9/52* (2013.01); *C22C 1/002* (2013.01); *C22C 33/003* (2013.01); *C22C 45/00* (2013.01); *C22C 45/006* (2013.01); *C22C 45/008* (2013.01); *C22C 45/02* (2013.01); *C22C 45/04* (2013.01); *C22F 1/002* (2013.01); *C22C 2200/02* (2013.01)

(56) References Cited

U.S. PATENT DOCUMENTS

| | | | | |
|---|---|---|---|---|
| 5,765,625 | A | 6/1998 | Yukumoto | |
| 6,749,700 | B2 * | 6/2004 | Sunakawa | C22C 33/003 148/561 |
| 8,968,489 | B2 * | 3/2015 | Azuma | B22D 11/0611 148/304 |
| 8,974,609 | B2 * | 3/2015 | Ogawa | B22D 11/0611 148/304 |
| 2003/0041931 | A1 | 3/2003 | Sunakawa et al. | |
| 2010/0132907 | A1 * | 6/2010 | Ozaki | B22D 11/0611 164/122 |
| 2010/0163136 | A1 * | 7/2010 | Ozaki | B22D 11/0611 148/304 |
| 2012/0062351 | A1 * | 3/2012 | Theisen | B22D 11/001 336/213 |

FOREIGN PATENT DOCUMENTS

| | | | |
|---|---|---|---|
| JP | 62-142055 | A | 6/1987 |
| JP | 62-259645 | A | 11/1987 |
| JP | 01169905 | A | 7/1989 |
| JP | 3-18459 | A | 1/1991 |
| JP | 7-132351 | A | 5/1995 |
| JP | 3494371 | B2 | 2/2004 |

OTHER PUBLICATIONS

Communication dated Jun. 18, 2015 from the State Intellectual Property Office of the People's Republic of China in counterpart Application No. 201380014124.9.

International Search Report for PCT/JP2013/056354 dated May 14, 2013.

Translation of JP 07-132351 from J-Plat Pat, original document published May 23, 1995.

Office Action dated Mar. 14, 2018 issued from the State Intellectual Property Office of P. R. China in Chinese Application No. 201510713855.3.

* cited by examiner

AMORPHOUS ALLOY RIBBON AND METHOD OF PRODUCING THE SAME

CROSS REFERENCE TO RELATED APPLICATIONS

This application is a divisional of application Ser. No. 14/384,537 filed Sep. 11, 2014, which is the National Stage of International Application No. PCT/JP2013/056354 filed Mar. 7, 2013 (claiming priority based on Japanese Patent Application No. 2012-058715 filed Mar. 15, 2012), the contents of which are incorporated herein by reference in their entirety.

TECHNICAL FIELD

The present invention relates to an amorphous alloy ribbon and a method of producing the same.

BACKGROUND ART

As a method of producing an amorphous alloy ribbon to be used for a core or a magnetic shield material, a liquid quenching method is widely known. As a liquid quenching method, there are a single-roll method (for example, see Japanese Patent No. 3494371), a twin-roll method (for example, see Japanese Patent Application Laid-Open (JP-A) No. H03-18459), a centrifugation method, or the like, and considering productivity or maintainability, a single-roll method is superior, by which a molten alloy is supplied through a molten metal nozzle to a surface of a rotating chill roll, and solidified by quenching to yield an amorphous alloy ribbon.

By a single-roll method, a ribbon is produced by forming a reservoir of a molten alloy (also known as a "puddle") with a chill roll surface and a molten metal nozzle, and consequently a broad ribbon can be produced favorably.

SUMMARY OF INVENTION

Technical Problem

Meanwhile, with respect to an amorphous alloy ribbon produced, for example, by a single-roll method, a width-direction end of the ribbon does not form a smooth shape, but the end tends to form a serrated feathered shape (for example, see FIG. 5). A single protrusion included in the serrated feathered shape (corresponding to a single serration) is herein referred to as a "feather". Since an amorphous alloy ribbon tends to be embrittled by heat treatment, in a case in which a feather (in particular, a feather having a length, as measured along a longitudinal direction of the ribbon, of 1 mm or more) is generated at width-direction ends, detachment of a feather may be problematic. In a case in which an amorphous alloy ribbon is used, for example, as a core of a transformer and a feather falls off, the fallen feather will cause an electrical short, thereby increasing core loss or, in a worst-case situation, breaking the transformer.

With regard to the problem of detachment of a feather, currently, amorphous alloy ribbons are layered one on another to produce a core and heat-treated, and then a width-direction ends of the amorphous alloy ribbons are carefully coated with an epoxy resin or the like so that the feathers do not fall off, thereby suppressing feather detachment in a subsequent processing step such as a transformer assembly step.

However as a method for suppressing detachment of a feather, a more fundamental method by which feather generation itself can be suppressed, has been sought.

Consequently, an object of the invention is to provide a method of producing an amorphous alloy ribbon, by which generation of feathers at width-direction ends of a ribbon can be suppressed, and feather detachment after heat treatment can be suppressed. Further, an object of the invention is to provide an amorphous alloy ribbon in which feather detachment after heat treatment can be suppressed.

Solution to Problem

Specific means for attaining the objects are as follows.

<1> A method of producing an amorphous alloy ribbon, comprising: a step of producing an amorphous alloy ribbon by discharging a molten alloy through a rectangular opening of a molten metal nozzle having a molten metal flow channel along which the molten alloy flows, the opening being an end of the molten metal flow channel, onto a surface of a rotating chill roll, wherein, among wall surfaces of the molten metal flow channel, a maximum height Rz(t) of a surface t, which is a wall surface that is parallel to a flow direction of the molten alloy and to a short side direction of the opening, is 10.5 μm or less.

<2> The production method of an amorphous alloy ribbon according to <1>, wherein the molten alloy is discharged onto a surface of the chill roll rotating at a circumferential speed of from 10 m/s to 40 m/s in the step of producing the amorphous alloy ribbon.

<3> The production method of an amorphous alloy ribbon according to <1> or <2>, wherein the molten alloy is discharged at a discharge pressure of from 10 kPa to 30 kPa in the step of producing the amorphous alloy ribbon.

<4> The production method of an amorphous alloy ribbon according to any one of <1> to <3>, wherein, among wall surfaces of the molten metal flow channel, a maximum height Rz(s) of a surface s, which is a wall surface that is parallel to a flow direction of the molten alloy and to a long side direction of the opening, is 60.0 μm or less.

<5> The production method of an amorphous alloy ribbon according to any one of <1> to <4>, wherein, among wall surfaces of the molten metal flow channel, a maximum height Rz(s) of a surface s, which is a wall surface that is parallel to a flow direction of the molten alloy and to a long side direction of the opening, is from 20.0 μm to 60.0 μm.

<6> The production method of an amorphous alloy ribbon according to any one of <1> to <5>, wherein the length of a long side of the opening is from 100 mm to 300 mm.

<7> The production method of an amorphous alloy ribbon according to any one of <1> to <6>, wherein the length of a short side of the opening is from 0.1 mm to 1.0 mm.

<8> An amorphous alloy ribbon, in which a number of feathers having a length of 1 mm or longer measured along a longitudinal direction of the ribbon at width-direction ends of the ribbon is 1 or less per 1 m of length of the ribbon in a longitudinal direction.

<9> The amorphous alloy ribbon according to <8>, which is produced by a single-roll method.

<10> The alloy ribbon according to <8> or <9>, having a thickness of from 10 μm to 40 μm and a width of from 100 mm to 300 mm.

Advantageous Effects of Invention

The invention can provide a method of producing an amorphous alloy ribbon, by which generation of feathers at width-direction ends of a ribbon can be suppressed, and feather detachment after heat treatment can be suppressed. Further, the invention can provide an amorphous alloy ribbon in which feather detachment after heat treatment can be suppressed.

DESCRIPTION OF EMBODIMENTS

A method of producing an amorphous alloy ribbon and an amorphous alloy ribbon according to the invention will be described in detail below.

<Method of Producing Amorphous Alloy Ribbon>

A method of producing an amorphous alloy ribbon (hereinafter also simply referred to as "ribbon") according to the invention includes: a step of producing an amorphous alloy ribbon by discharging a molten alloy through a rectangular opening of a molten metal nozzle having a molten metal flow channel along which the molten alloy flows, the opening (for example, the opening 11 in FIG. 2 described below) being an end of the molten metal flow channel, onto a surface of a rotating chill roll, wherein, among wall surfaces of the molten metal flow channel, a maximum height Rz(t) of a surface t (for example, surface t in FIG. 2 and FIG. 3 described below), which is a wall surface that is parallel to a flow direction of the molten alloy and to a short side direction of the opening, is 10.5 μm or less.

Surface roughness (maximum height Rz and arithmetic average roughness Ra described below) means herein surface roughness measured according to JIS B 0601 (2001).

Further, the surface roughness (maximum height Rz and arithmetic average roughness Ra described below) means herein values measured along the flow direction of a molten alloy (for example, in FIG. 2 the direction of the arrow Q).

With respect to a ribbon produced by a conventional method of producing an amorphous alloy ribbon, width-direction ends does not form a smooth shape, but feathers are generated at width-direction ends.

Since an amorphous alloy ribbon tends to be embrittled by heat treatment, in a case in which a feather (in particular, a feather having a length, as measured along a longitudinal direction of the ribbon, of 1 mm or more) is generated at width-direction ends, detachment of a feather may be problematic.

A feather having a length, as measured along a longitudinal direction of the ribbon, of 1 mm or more is herein also simply referred to as "feather having a length of 1 mm or longer".

In contrast to the conventional method, by a method of producing an amorphous alloy ribbon according to the invention, generation of feathers (in particular, a feather having a length of 1 mm or longer) at width-direction ends of a ribbon can be suppressed, and therefore feather detachment after heat treatment can be suppressed.

Now, a feather and the length of a feather will be described referring to FIG. 5.

Figure 5:
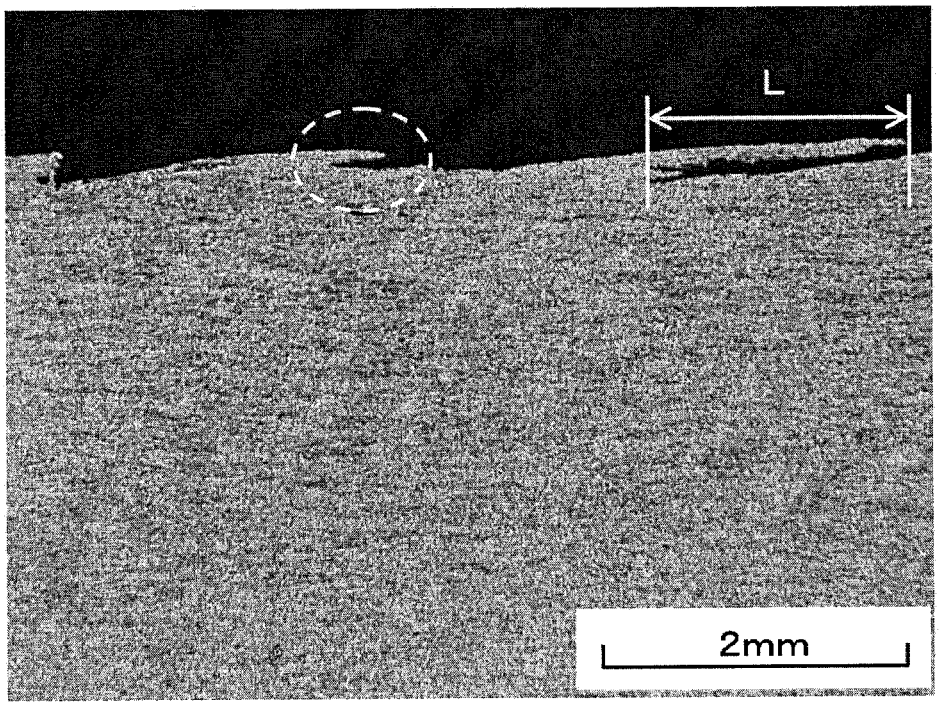
FIG. 5 is an optical microscope photograph of an end of an amorphous alloy ribbon in Comparative Example 1.

FIG. 5 is an optical microscope photograph of an end of an amorphous alloy ribbon in Comparative Example 1 described below.

In FIG. 5 a gray region in the lower part is an amorphous alloy ribbon, and a black region in the upper part is a back ground.

With respect to an amorphous alloy ribbon according to Comparative Example 1 shown in FIG. 5, three feathers are recognized at an end (in FIG. 5, a central feather of three feathers is circled by a dashed line).

The length L in FIG. 5 represents the length of a feather in a longitudinal direction of a ribbon.

Figure 1:
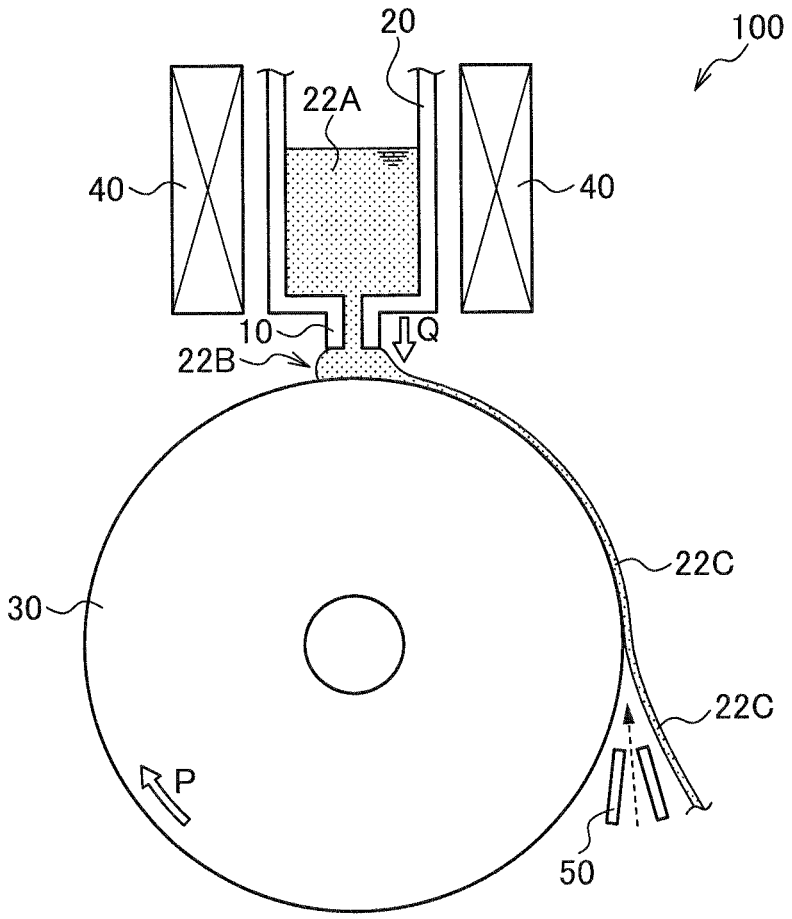
FIG. 1 is a conceptual schematic cross-sectional view of an embodiment of an amorphous alloy ribbon production apparatus appropriate for a production method of an amorphous alloy ribbon according to the invention.

Here, the longitudinal direction of a ribbon is identical with the rotational direction of a chill roll (for example, the arrow P in FIG. 1).

In FIG. 5, the right feather among three feathers has a length of 1 mm or longer measured along a longitudinal direction of the ribbon. Namely, the feather on the right side is a "feather having a length of 1 mm or longer". Since a "feather having a length of 1 mm or longer" is prone to detach after heat treatment, it is required to suppress generation of such a feather.

By a production method according to the invention, particularly generation of such a "feather having a length of 1 mm or longer" can be suppressed (for example, see FIG. 4 (Example 1) described below).

Although a detailed reason for suppression of feather generation according to the invention is not clear yet, it is presumed as follows.

With respect to a production method, by which a molten alloy is discharged from a rectangular opening of a molten metal nozzle onto a surface of a rotating chill roll, it is conceivable that the supply of a molten alloy to a chill roll is not stable, in a case in which a flow of a molten alloy in the vicinity of the surface t is a turbulent flow, and the vibration of a width-direction end of the puddle formed on a surface of a chill roll (specifically, vibration in the axis direction of a chill roll) becomes strong. When the chill roll rotates with a width-direction end of the puddle vibrating, presumably, the puddle end when stuck out by the vibration is stretched in a counter-rotational direction to form a feather.

Further in connection with the above phenomenon, it can be presumed that a flow of a molten alloy in the vicinity of the surface t can be made easily to a laminar flow by smoothing the surface t to a maximum height Rz (t) of 10.5 μm or less, and as the result, supply of a molten alloy to a chill roll can be stabilized, the vibration at width-direction ends of a puddle can be suppressed, and in consequence generation of a feather can be suppressed.

The inventors have discovered a finding that the roughness of the surface t has a major influence (compared to the influence of the roughness of the surface s described below) on existence or nonexistence of a feather on a ribbon, further a finding that generation of feathers can be suppressed by smoothing the surface t to a maximum height Rz (t) of 10.5 μm or less, and finally completed the invention based on the findings.

When the maximum height Rz (t) exceeds 10.5 μm, generation of feathers becomes remarkable. This is conceivably because the vibration of width-direction ends of a puddle becomes stronger.

From a viewpoint of better suppression of generation of feathers, the maximum height Rz (t) is preferably 10.0 μm or less.

Although there is no particular restriction according to the invention on a maximum height Rz (s) of a surface s which is a wall surface parallel to a flow direction of the molten alloy and to a long side direction of the opening among wall surfaces of the molten metal flow channel (for example, the surface s in FIG. 2 and FIG. 3 described below), from a viewpoint of better suppression of generation of feathers, the Rz (s) is preferably 60.0 μm or less, and more preferably 50.0 μm or less.

Furthermore, when the Rz (s) is 60.0 μm or less, adhesion of an inclusion (precipitate or the like originated from a molten alloy) to the surface s is better suppressed, and an amorphous alloy ribbon can be produced more stably.

Meanwhile, from a viewpoint of easier adjustment (polishing or the like) of the Rz over a broad range, the Rz (s) is preferably 20.0 μm or more, and more preferably 30.0 μm or more.

There is no particular restriction on a method for adjusting the Rz (t) and the Rz (s) in the ranges, and, for example, a method of polishing with a file (for example, diamond file), or a brush can be used. Polishing is especially appropriate from viewpoints of workability and process management.

An embodiment of a production method of an amorphous alloy ribbon according to the invention will be described below referring to FIG. 1 to FIG. 3.

FIG. 1 is a conceptual schematic cross-sectional view of an embodiment of an amorphous alloy ribbon production apparatus appropriate for a production method of an amorphous alloy ribbon according to the invention.

An amorphous alloy ribbon production apparatus 100 shown in FIG. 1 is an amorphous alloy ribbon production apparatus based on a single-roll method.

As shown in FIG. 1, the amorphous alloy ribbon production apparatus 100 is provided with a crucible 20 provided with a molten metal nozzle 10, and a chill roll 30, a surface of which faces a tip of the molten metal nozzle 10. FIG. 1 is a cross-sectional view of the amorphous alloy ribbon production apparatus 100 sectioned by a plane perpendicular to the axis direction of the chill roll 30 and to the width direction of an amorphous alloy ribbon 22C (the two directions are identical).

The crucible 20 has an internal space that can accommodate a molten alloy 22A, which is a source material for an amorphous alloy ribbon, and the internal space is communicated with a molten metal flow channel of a molten metal nozzle 10. As a result, a molten alloy 22A accommodated in the crucible 20 can be discharged through the molten metal nozzle 10 to a chill roll 30 (in FIG. 1 and FIG. 2, the discharge direction and the flow direction of the molten alloy 22A is represented by the arrow Q). A crucible 20 and a molten metal nozzle 10 may be configured as an integrated body or as separate bodies.

At least partly around a crucible 20, a high-frequency coil 40 is placed as a heating means. By this, a crucible 20 in a state accommodating a mother alloy of an amorphous alloy ribbon can be heated to form a molten alloy 22A in the crucible 20, or a molten alloy 22A supplied from the outside to the crucible 20 can be kept in a liquid state.

The distance between a tip of a molten metal nozzle 10 and a surface of a chill roll 30 (hereinafter also referred to as "gap") is so small, that, when a molten alloy 22A is discharged through a molten metal nozzle 10, a puddle 22B of a molten alloy 22A is formed.

Although the distance may be in a range ordinarily set for a single-roll method, it is preferably 500 μm or less, and more preferably 300 μm or less.

Further, from a viewpoint of suppression of contact between a tip of a molten metal nozzle 10 and a surface of a chill roll 30, the distance is preferably 50 μm or more.

A chill roll 30 is configured such that it rotates axially to the direction of the arrow P.

A cooling medium such as water is circulated inside a chill roll 30, with which a molten alloy 22A coated (discharged) on a surface of a chill roll 30 can be cooled to form an amorphous alloy ribbon 22C.

There is no particular restriction on the length of a chill roll 30 in the axial direction, insofar as it is longer than the width of an amorphous alloy ribbon to be produced (the length of a long side of an opening of a nozzle described below).

From a viewpoint of cooling power, the diameter of a chill roll 30 is preferably 200 mm or more, and more preferably 300 mm or more. Meanwhile, from a viewpoint of cooling power, the diameter is preferably 700 mm or less.

The material of a chill roll 30 is preferably a material having high thermal conductivity, such as Cu, or a Cu alloy (a Cu—Be alloy, a Cu—Cr alloy, a Cu—Zr alloy, a Cu—Zn alloy, a Cu—Sn alloy, a Cu—Ti alloy, or the like).

Although there is no particular restriction on the surface roughness of a surface of a chill roll 30, from a viewpoint of better suppression of the vibration of the puddle ends, the maximum height (Rz) of a surface of a chill roll 30 is preferably 1.5 μm or less, and more preferably 1.0 μm or less.

Similarly, from a viewpoint of better suppression of the vibration of the puddle ends, the arithmetic average roughness (Ra) of a surface of a chill roll 30 is preferably 0.5 μm or less.

Further, as a chill roll 30, a chill roll used ordinarily in a single-roll method can be used.

Close to a surface of a chill roll 30 (downstream of a molten metal nozzle 10 in the rotational direction of a chill roll 30), a peeling gas nozzle 50 is placed. This blows a peeling gas (for example, a nitrogen gas, or a high pressure gas such as compressed air) in the direction (the direction of a dashed line arrow in FIG. 1) opposite to the rotational direction of a chill roll 30 (arrow P), such that peeling of an amorphous alloy ribbon 22C from a chill roll 30 can be performed more efficiently.

An amorphous alloy ribbon production apparatus 100 may be provided with another component in addition to the above components (for example, a wind-up roll for reeling up a produced amorphous alloy ribbon 22C, or a gas nozzle for blowing a $CO_2$ gas, a $N_2$ gas, or the like to a puddle 22B of a molten alloy or its vicinity).

Further, a basic configuration of an amorphous alloy ribbon production apparatus 100 may be similar to a configuration of an amorphous alloy ribbon production apparatus based on a conventional single-roll method (for example, see Japanese Patent No. 3494371, Japanese Patent No. 3594123, Japanese Patent No. 4244123, and Japanese Patent No. 4529106).

Figure 2:
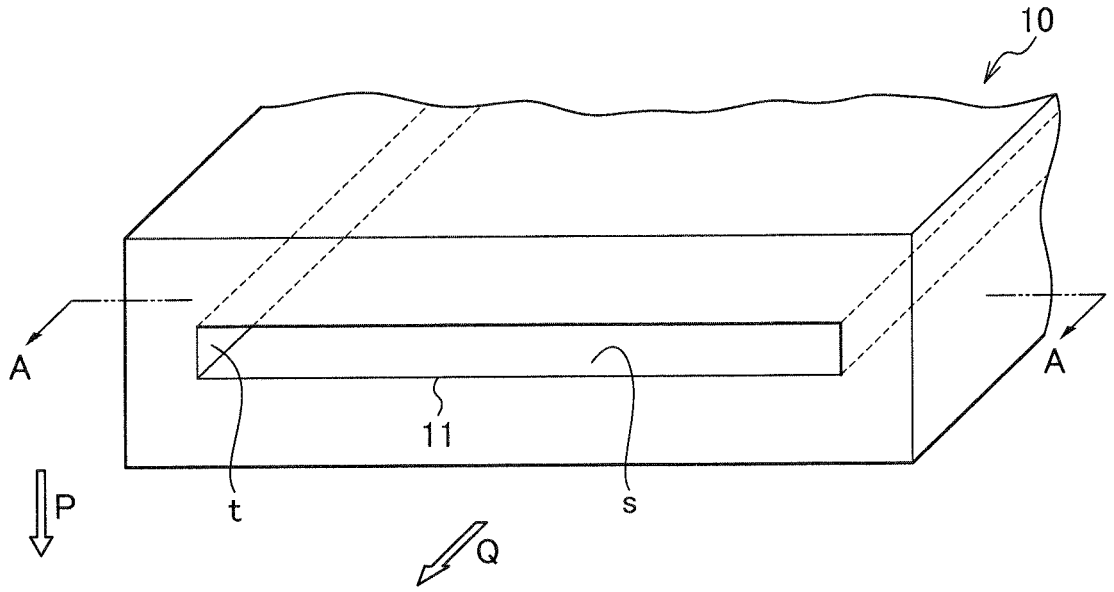
FIG. 2 is a perspective view of a molten metal nozzle of the amorphous alloy ribbon production apparatus shown in FIG. 1.

FIG. 2 is a perspective view of a molten metal nozzle 10 of the amorphous alloy ribbon production apparatus 100 shown in FIG. 1. FIG. 3 is a cross-sectional view along the line A-A in FIG. 2.

Figure 3:
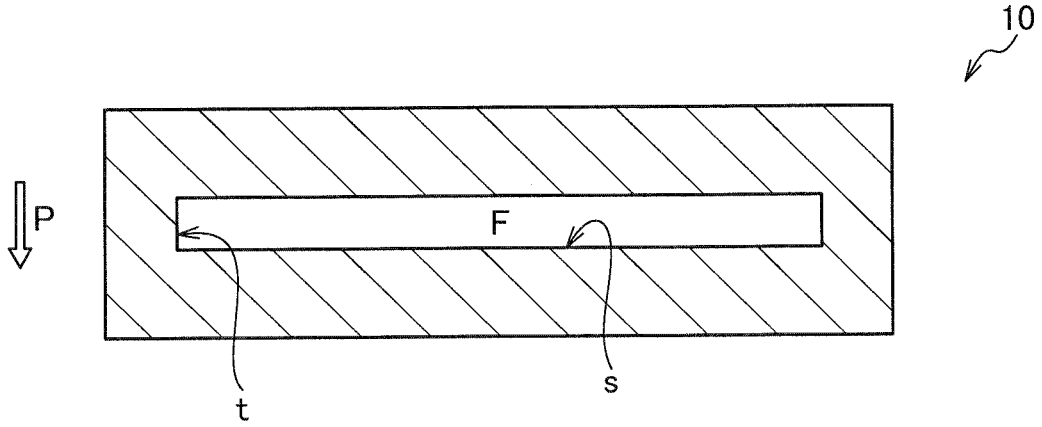
FIG. 3 is a cross-sectional view along the line A-A in FIG. 2.

As shown in FIG. 3, a molten metal nozzle 10 has a molten metal flow channel F, where a molten alloy flows. An end of the molten metal flow channel F in the flow direction of a molten alloy is a rectangular (slit shape) opening 11

(FIG. 2) for discharging a molten alloy. On the other hand, the other end of the molten metal flow channel F in the flow direction of a molten alloy is communicated with the internal space of a crucible 20 shown in FIG. 1.

In this regard, a cross-section of the molten metal flow channel F sectioned by a plane perpendicular to the flow direction of a molten alloy (FIG. 3) is also rectangular (slit shape) similar to the opening 11 (FIG. 2). In other words, the molten metal flow channel F is a rectangular prismatic space with a rectangular opening (open end).

The length of a long side of the opening 11 is a length corresponding to the width of an amorphous alloy ribbon to be produced. The length of a long side of the opening 11 is preferably 100 mm or more, and more preferably 125 mm or more. Meanwhile, the length of the long side is preferably 300 mm or less.

Further, from a viewpoint of stable production of an amorphous alloy ribbon under general casting conditions (speed, gap, and discharge pressure), the length of a short side of the opening 11 is preferably 0.1 mm or more, and more preferably 0.4 mm or more. From the same viewpoint, the length of the short side is preferably 1.0 mm or less, and more preferably 0.7 mm or less.

The material of a molten metal nozzle 10 is preferably silicon nitride, sialon, alumina-zirconia, zircon, or the like from a viewpoint of resistance to thermal shock.

Further, from a viewpoint of straightening of a molten metal flow, the channel length of a molten metal flow channel F (the length of a molten metal flow channel F in the flow direction of a molten alloy) is preferably 30 mm or less, and more preferably 20 mm or less.

A range of the maximum height (Rz (t)) of the surface t among wall surfaces of a molten metal flow channel F according to the embodiment is as described above, and a preferable range is also as described above. A preferable range of the maximum height (Rz (s)) of the surface s is also as described above.

Next, back to FIG. 1, an example of production of an amorphous alloy ribbon 22C using an amorphous alloy ribbon production apparatus 100 will be described.

Firstly, a mother alloy is placed in a crucible 20, and the mother alloy is melted by high frequency induction heating with a high-frequency coil 40 to form a molten alloy 22A. Although there is no particular restriction on the temperature of a molten alloy 22A, it is preferably the melting point of the mother alloy +50° C. or higher from a viewpoint of suppression of adhesion of a precipitate originated from a molten alloy 22A on to a wall surface of a molten metal nozzle. Further, the temperature of a molten alloy 22A is preferably the melting point of the mother alloy +250° C. or lower from a viewpoint of suppression of formation of an air pocket to be formed on the side of a contact surface with a surface of a chill roll 30.

Next, a molten alloy is discharged through a molten metal nozzle 10 onto a surface of a chill roll 30 rotating in the direction of the arrow P, while forming a puddle 22B, to form a coated film of the molten alloy on the surface of a chill roll 30, and the coated film is cooled to form an amorphous alloy ribbon 22C. Then the amorphous alloy ribbon 22C formed on the surface of a chill roll 30 is peeled from the surface of a chill roll 30 by blowing a peeling gas from a peeling gas nozzle 50 and reeled up on a wind-up roll (not illustrated) in a form of a roll for recovery.

Operations from discharging of a molten alloy to reeling-up (recovery) of an amorphous alloy ribbon are carried out continuously, and as the result, a long amorphous alloy ribbon having, for example, a longitudinal direction length of 3000 m or more can be obtained.

In this case, the discharge pressure of a molten alloy is preferably 10 kPa or more, and more preferably 15 kPa or more. Meanwhile, the discharge pressure is preferably 30 kPa or less, and more preferably 25 kPa or less.

When the discharge pressure is within the preferable range, a reducing effect on feathers according to the invention (in other words, a reducing effect on feathers by smoothing Rz (t) to 10.5 μm or less; the same applies hereinbelow.) can be obtained more significantly.

The rotation speed of a chill roll 30 may be in a range ordinarily set for a single-roll method, and a circumferential speed of 40 m/s or less is preferable, and a circumferential speed of 30 m/s or less is more preferable. Meanwhile, the rotation speed in terms of a circumferential speed of 10 m/s or more is preferable, and a circumferential speed of 20 m/s or more is more preferable.

When the rotation speed is within the preferable range, a reducing effect on feathers according to the invention can be obtained more significantly.

The temperature of a surface of a chill roll 30 after elapse of 5 sec or more from the initiation of a supply of a molten alloy onto a surface of a chill roll 30 is preferably 80° C. or more, and more preferably 100° C. or more. Meanwhile, the temperature is preferably 300° C. or less, and more preferably 250° C. or less.

The cooling rate of a molten alloy by a chill roll 30 is preferably $1\times10^{5}$° C./s or more, and more preferably $1\times10^{6}$° C./s or more.

In the present production method, there is no particular restriction on the compositions of a mother alloy and a molten alloy, and they may be selected appropriately according to the composition of an amorphous alloy ribbon to be produced. An example of the composition of an amorphous alloy ribbon will be described below.

The production method of an amorphous alloy ribbon according to the invention described above is especially appropriate as a production method of the following amorphous alloy ribbon.

<Amorphous Alloy Ribbon>

With respect to an amorphous alloy ribbon according to the invention, the number of feathers having a length of 1 mm or longer as measured along a longitudinal direction of the ribbon at width-direction ends of the ribbon (feathers having a length of 1 mm or longer) is 1 or less per 1 m of length of the ribbon in a longitudinal direction.

"The number of the feathers is 1 or less per 1 m of length of the ribbon in a longitudinal direction" means that when a one-meter portion of the longitudinal direction length of both width-direction ends of a ribbon are observed (in other words, when a total range of 2 m is observed), the total number of the feathers is 1 or less.

As the result of investigation by the inventors, it became clear that a feather having a length of 1 mm or longer is prone to detach when an amorphous alloy is embrittled by heat treatment (for example, by heat treatment in a magnetic field). In particular, it became clear that when the number of feathers having a length of 1 mm or longer exceeds 1 per 1 m of length of the ribbon in a longitudinal direction, there is significant detachment of feathers embrittled by heat treatment. Further, it became clear that when the number of feathers is adjusted to 1 or less per 1 m of length of the ribbon in a longitudinal direction, detachment of feathers embrittled by heat treatment is significantly reduced.

Consequently, in an amorphous alloy ribbon according to the invention, detachment of feathers embrittled by heat treatment can be suppressed.

The number of the feather having a length of 1 mm or longer is especially preferably 0 per 1 m of length of the ribbon in the longitudinal direction (in other words, a feather having a length of 1 mm or longer is not present per 1 m of length of the ribbon in the longitudinal direction).

Although there is no particular restriction on the width of an amorphous alloy ribbon according to the invention, from a viewpoint of practicality of an amorphous alloy ribbon, the width is preferably 100 mm or more, and more preferably 125 mm or more.

Meanwhile, from a viewpoint of productivity of an amorphous alloy ribbon production apparatus, the width of an amorphous alloy ribbon according to the invention is preferably 300 mm or less.

Further, although there is no particular restriction on the thickness (web thickness) of an amorphous alloy ribbon according to the invention, from a viewpoint of improvement in mechanical strength, the thickness is preferably 10 μm or more, more preferably 15 μm or more, and especially preferably 20 μm or more.

Meanwhile, from a viewpoint of stable formation of an amorphous phase, the thickness is preferably 40 μm or less, more preferably 35 μm or less, and especially preferably 30 μm or less.

An amorphous alloy ribbon according to the invention is produced for example by a single-roll method.

Especially, an amorphous alloy ribbon according to the invention can be produced favorably by the production method of the invention described above.

There is no particular restriction on an amorphous alloy (composition) composing an amorphous alloy ribbon according to the invention, and examples thereof include an Fe-based amorphous alloy, a Ni-based amorphous alloy, and a CoCr-based amorphous alloy.

Here, an Fe-based amorphous alloy means an amorphous alloy containing Fe as a main component.

A Ni-based amorphous alloy means an amorphous alloy containing Ni as a main component.

A CoCr-based amorphous alloy means an amorphous alloy containing Co and Cr as main components.

In this regard, a "main component" means a component, which content is highest.

As the composition of the Fe-based amorphous alloy, a composition containing Fe at 50 atom % or more is preferable, a composition containing Fe at 60 atom % or more is more preferable, and a composition containing Fe at 70 atom % or more is further preferable.

Further, a composition, in which the content of Si is from 2 to 25 atom %, the content of B is from 2 to 25 atom %, and the balance is Fe and unavoidable impurities, is preferable; a composition, in which the content of Si is from 2 to 22 atom %, the content of B is from 5 to 16 atom %, and the balance is Fe and unavoidable impurities, is more preferable; and a composition, in which the content of Si is from 2 to 10 atom %, the content of B is from 10 to 16 atom %, and the balance is Fe and unavoidable impurities, is especially preferable.

Examples of the unavoidable impurities in the Fe-based amorphous alloy include C, Al, Cr, W, P, Mn, Zn, Ti, and Cu.

The content of the unavoidable impurities in the Fe-based amorphous alloy is preferably less than 2 atom %, and especially preferably 1 atom % or less.

As the composition of the Ni-based amorphous alloy, a composition containing Ni at 40 atom % or more is preferable, a composition containing Ni at 50 atom % or more is more preferable, and a composition containing Ni at 60 atom % or more is especially preferable.

As the composition of the Ni-based amorphous alloy, a composition in which the content of Ni is from 60 to 80 atom %, the content of Si is from 2 to 15 atom %, the content of B is from 5 to 15 atom %, (further, if necessary, containing at least one of Cr at from 2 to 20 atom %, Fe at from 2 to 5 atom %, W at from 2 to 5 atom %, or Co at from 15 to 20 atom %), and the balance is unavoidable impurities; a composition in which the content of Ni is from 40 to 70 atom %, the content of B is from 15 to 20 atom %, the content of Cr is from 10 to 15 atom %, (further, if necessary, containing at least one of Co at from 15 to 20 atom %, Fe at from 2 to 5 atom %, or Mo at from 2 to 5 atom %), and the balance is unavoidable impurities; or a composition in which the content of Ni is from 60 to 85 atom %, the content of P is from 15 to 20 atom %, (further, if necessary, containing Cr at from 15 to 20 atom %), and the balance is unavoidable impurities; is especially preferable.

Examples of the unavoidable impurities in the Ni-based amorphous alloy include C, Al, Mn, Zn, Ti, and Cu.

The content of the unavoidable impurities in the Ni-based amorphous alloy is preferably less than 2 atom %, and especially preferably 1 atom % or less.

As the composition of the CoCr-based amorphous alloy, a composition containing Co and Cr in total 50 atom % or more is preferable, and a composition containing Co and Cr in total 60 atom % or more is more preferable.

The content of Co in the CoCr-based amorphous alloy is preferably 30 atom % or more, more preferably 50 atom % or more, and especially preferably 60 atom % or more.

The content of Cr in the CoCr-based amorphous alloy is preferably 10 atom % or more, more preferably 15 atom % or more, and especially preferably 20 atom % or more.

Further examples of the Co-based amorphous alloy include a composition, in which the content of Co is from 60 to 80 atom %, the content of B is from 5 to 15 atom %, the content of Cr is from 15 to 25 atom %, (if necessary, containing further Si at from 2 to 5 atom %), and the balance is unavoidable impurities; and a composition, in which the content of Co is from 30 to 60 atom %, the content of B is from 5 to 15 atom %, the content of Cr is from 20 to 40 atom %, the content of W is from 5 to 15 atom %, (further, if necessary, containing at least one of Fe at from 2 to 5 atom %, Si at from 2 to 5 atom %, Ni at from 2 to 5 atom %, or C at from 2 to 8 atom %), and the balance is unavoidable impurities.

Examples of the unavoidable impurities in the CoCr-based amorphous alloy include C, Al, P, Mn, Zn, and Ti.

The content of the unavoidable impurities in the CoCr-based amorphous alloy is preferably less than 2 atom %, and especially preferably 1 atom % or less.

Specific examples of a composition of an amorphous alloy according to the invention are shown in the following Table 1, provided that the invention is not limited to the following specific examples.

In the following Table 1, "%" means atom %. In the case of a component having a content of less than 2 atom %, the component is deemed as an unavoidable impurity and description of the same is omitted. Further, the relative contents based on the total components excluding unavoidable impurities as 100 atom % are described therein.

TABLE 1

| Alloy No. | Classification | Fe | Si | B | Ni | Co | Cr | C | P | Mo | W |
|---|---|---|---|---|---|---|---|---|---|---|---|
| 1 | Fe-based | 83% | 2% | 15% | | | | | | | |
| 2 | | 83% | 3% | 14% | | | | | | | |
| 3 | | 82% | 2% | 16% | | | | | | | |
| 4 | | 82% | 3% | 15% | | | | | | | |
| 5 | | 82% | 4% | 14% | | | | | | | |
| 6 | | 82% | 5% | 13% | | | | | | | |
| 7 | | 81% | 6% | 13% | | | | | | | |
| 8 | | 81% | 7% | 12% | | | | | | | |
| 9 | | 80% | 8% | 12% | | | | | | | |
| 10 | | 80% | 9% | 11% | | | | | | | |
| 11 | | 79% | 10% | 11% | | | | | | | |
| 12 | | 79% | 11% | 10% | | | | | | | |
| 13 | | 78% | 12% | 10% | | | | | | | |
| 14 | | 78% | 13% | 9% | | | | | | | |
| 15 | | 77% | 14% | 9% | | | | | | | |
| 16 | | 77% | 15% | 8% | | | | | | | |
| 17 | | 76% | 16% | 8% | | | | | | | |
| 18 | | 76% | 17% | 7% | | | | | | | |
| 19 | | 75% | 18% | 7% | | | | | | | |
| 20 | | 75% | 19% | 6% | | | | | | | |
| 21 | | 74% | 20% | 6% | | | | | | | |
| 22 | | 74% | 21% | 5% | | | | | | | |
| 23 | | 73% | 22% | 5% | | | | | | | |
| 24 | Ni-based | 4% | 8% | 13% | 63% | | 12% | | | | |
| 25 | | 3% | 8% | 14% | 68% | | 7% | | | | |
| 26 | | | 8% | 15% | 77% | | | | | | |
| 27 | | | 13% | 7% | 62% | | 18% | | | | |
| 28 | | | | | 81% | | | | 19% | | |
| 29 | | | | 18% | 68% | | 14% | | | | |
| 30 | | 4% | 8% | 14% | 61% | | 13% | | | | |
| 31 | | 4% | 3% | 11% | 68% | | 12% | | | | 2% |
| 32 | | | 13% | 10% | 77% | | | | | | |
| 33 | | | 10% | 8% | 82% | | | | | | |
| 34 | | | 13% | 7% | 75% | | 5% | | | | |
| 35 | | | | | 69% | | 14% | | 17% | | |
| 36 | | 5% | | 17% | 44% | 20% | 10% | | | 4% | |
| 37 | | | 7% | 13% | 63% | 17% | | | | | |
| 38 | CoCr-based | | 3% | 12% | | 64% | 21% | | | | |
| 39 | | 3% | 2% | 14% | 3% | 30% | 32% | 5% | | | 11% |

EXAMPLES

The invention will be described specifically blow by way of Examples, provided that the invention is not limited to the Examples.

[Example 1] <Production of Amorphous Alloy Ribbon>

An amorphous alloy ribbon production apparatus configured similarly to the amorphous alloy ribbon production apparatus 100 in FIG. 1 was prepared. As a molten metal nozzle and a chill roll, the following molten metal nozzle and chill roll were prepared.

—Molten Metal Nozzle—

Material: Silicon nitride

Size of opening: Length of long side 142 mm×length of short side 0.6 mm

Length of molten metal flow channel: 10 mm

Maximum heights of wall surfaces of molten metal flow channel (Rz (s), Rz (t)):

Adjusted to the values described in the following Table 2.

In this regard, Rz (s) and Rz (t) were measured according to JIS B 0601 (2001). In this case, Rz (s) and Rz (t) were measured along the flow direction of a molten alloy (for example, along the direction of the arrow Q in FIG. 2).

Adjustment of a maximum height was carried out by polishing wall surfaces of a molten metal flow channel with a 180 grit-diamond file. In this case, with respect to the surface t having a small area, polishing was performed along the flow direction of a molten alloy (for example, the direction of the arrow Q in FIG. 2). With respect to the surface s having a broad area, polishing was performed not in a specific direction but nondirectionally.

—Chill Roll—

Material: Cu—Be alloy

Diameter: 400 mm

Maximum height Rz of chill roll surface: 1.5 μm or less

Arithmetic average roughness Ra of chill roll surface: 0.3 μm or less

Firstly, an ingot (mother alloy) having a composition with a content of Si of 9 atom %, a content of B of 11 atom %, and a balance of Fe and unavoidable impurities, was charged in a crucible, and then melted by high frequency induction heating to obtain a molten alloy.

Next, the molten alloy was discharged through the molten metal nozzle to a surface of a rotating chill roll for rapid solidification to produce 4200 kg of an amorphous alloy ribbon having a width of 142 mm and a thickness of 24 μm.

Detailed production conditions of an amorphous alloy ribbon were as follows.

Discharge pressure of molten alloy: 20 kPa

Circumferential speed of chill roll: 25 m/s

Temperature of molten alloy: 1300° C. (the melting point of the mother alloy: 1150° C.)

Distance (gap) between molten metal nozzle tip and chill roll surface: 200 μm

Cooling temperature (a temperature after elapse of 5 sec or more from the initiation of a supply of the molten alloy onto a surface of the chill roll): 170° C.

(Examination of Number of Feathers)

The number of feathers having a length of 1 mm or longer as measured along a longitudinal direction of the ribbon (feathers having a length of 1 mm or longer) was examined by observing a one-meter portion of the longitudinal direction length of both width-direction ends of the thus obtained amorphous alloy ribbon (observation range: 2 m as a total of the two ends) under an optical microscope (magnification 50-fold).

The examined total number of the feathers at both width-direction ends was determined as the number of feathers per 1 m length of the ribbon in a longitudinal direction (hereinafter occasionally written as "feather(s)/m"). For example, when the total number of the feathers at both width-direction ends is 1, the number of feathers of the amorphous alloy ribbon is written as "1 feather/m".

The results are shown in Table 2.

Examples 2 and 3 and Comparative Examples 1 to 4

An amorphous alloy ribbon was produced identically with Example 1, except that the maximum heights (Rz (s) and Rz (t)) of the wall surfaces of the molten metal flow channel of the molten metal nozzle were adjusted by polishing as shown in Table 2, and the number of feathers was examined identically with Example 1.

The results are shown in Table 2.

TABLE 2

| | Rz (s) | Rz (t) | Number of feathers having length of 1 mm or longer (feather(s)/m) |
|---|---|---|---|
| Example 1 | 37.3 | 9.4 | 0 |
| Example 2 | 40.3 | 10.5 | 1 |
| Example 3 | 48.3 | 8.3 | 0 |
| Comparative Example 1 | 35.3 | 18.9 | 14 |
| Comparative Example 2 | 48.7 | 27.9 | 12 |
| Comparative Example 3 | 49.4 | 19.4 | 8 |
| Comparative Example 4 | 49.4 | 11.5 | 5 |

As shown in Table 2, the number of feathers having a length of 1 mm or longer was dependent not on Rz (s) but on Rz (t). More particularly, by adjusting Rz (t) to 10.5 μm or less, the number of feathers having a length of 1 mm or longer could be reduced to 1 feather/m or less.

Further, although detailed measurements were not carried out, there were a very large number of feathers having a length not less than 0.1 mm but less than 1 mm at width-direction ends of ribbons in Comparative Examples 1 to 4, and the ends formed a serrated feathered shape (for example, see FIG. 5 hereinbelow).

Figure 4:
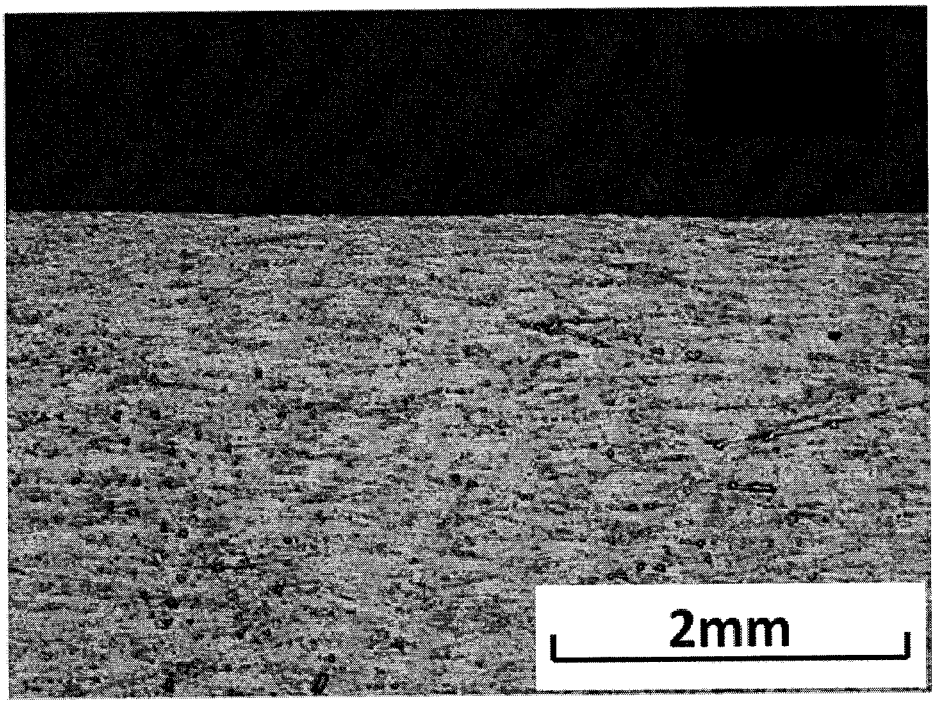
FIG. 4 is an optical microscope photograph of an end of an amorphous alloy ribbon in Example 1.

FIG. 4 is an optical microscope photograph of an end of the amorphous alloy ribbon in Example 1, and FIG. 5 is an optical microscope photograph of an end of the amorphous alloy ribbon in Comparative Example 1.

In each of FIG. 4 and FIG. 5, a gray region in the lower part is an amorphous alloy ribbon, and a black region in the upper part is a back ground.

As shown in FIG. 4, the amorphous alloy ribbon in Example 1 had very smooth (straight) width-direction ends. In contrast, the amorphous alloy ribbon in Comparative Example 1 had serrated feathered width-direction ends, and a large number of feathers including feathers having a length of 1 mm or longer and feathers having a length not less than 0.1 mm but less than 1 mm were present at the ends.

The entire contents of the disclosures by Japanese Patent Application No. 2012-058715 are incorporated herein by reference.

All the document, patent document, and technical standards cited herein are also herein incorporated by reference to the same extent as provided for specifically and severally with respect to an individual document, patent document, and technical standard to the effect that the same should be so incorporated by reference.

What is claimed is:

1. An amorphous alloy ribbon, in which a number of feathers protruding generally along a longitudinal direction of the ribbon and having a length of 1 mm or longer measured along the longitudinal direction at width-direction ends of the ribbon is 1 or less per 1 m of length of the ribbon in the longitudinal direction, wherein the ribbon has a thickness of from 10 μm to 40 μm and a width of from 100 mm to 300 mm.

2. The amorphous alloy ribbon according to claim 1, which is produced by a single-roll method.

* * * * *